US005205728A

United States Patent [19]

Mansour

[11] Patent Number: 5,205,728

[45] Date of Patent: Apr. 27, 1993

[54] PROCESS AND APPARATUS UTILIZING A PULSE COMBUSTOR FOR ATOMIZING LIQUIDS AND SLURRIES

[75] Inventor: Momtaz N. Mansour, Columbia, Md.

[73] Assignee: Manufacturing and Technology Conversion International, Columbia, Md.

[21] Appl. No.: 793,834

[22] Filed: Nov. 18, 1991

[51] Int. Cl.[5] ..... F23C 11/04

[52] U.S. Cl. ..... 431/1; 431/114; 110/212

[58] Field of Search ..... 431/1, 4, 5, 114; 110/238, 243, 212

[56] References Cited

U.S. PATENT DOCUMENTS

| | | | |
|---|---|---|---|
| 4,013,396 | 3/1977 | Tenney | 431/1 |
| 4,054,097 | 10/1977 | Barkhuus | 431/1 |
| 4,368,677 | 1/1983 | Kline | 431/1 X |
| 4,619,601 | 10/1986 | Sumitani | 431/1 |
| 4,622,003 | 11/1986 | Roth | 431/1 |
| 4,854,853 | 8/1989 | McElroy | 110/238 X |

*Primary Examiner*—Larry Jones

*Attorney, Agent, or Firm*—Dority & Manning

[57] ABSTRACT

An apparatus and process using a pulse combustor to atomize a liquid or slurry is provided. The apparatus includes a pulse combustor for generating a stream of atomization fluid and an oscillating flow field and introduction apparatus for introducing to the influence of the oscillating stream of atomization fluid a liquid or slurry to be atomized.

17 Claims, 5 Drawing Sheets

PROCESS AND APPARATUS UTILIZING A PULSE COMBUSTOR FOR ATOMIZING LIQUIDS AND SLURRIES

FIELD OF THE INVENTION

This invention relates to apparatus and processes using a pulse combustor to atomize liquids or slurries.

BACKGROUND OF THE INVENTION

Atomization of liquids and slurries is important for many systems. Particularly, atomization of fuels for combustion and gasification applications is a key step in attaining proper performance in such applications. Fuel that has been atomized into smaller particles typically enables more complete combustion, higher combustion temperatures, and better mixing of the fuel with air so as to increase combustion efficiency.

Primarily, two types of atomizers are in use today: (1) high pressure single-fluid atomizers (shown in FIG. 1) and (2) dual-fluid atomizers (shown in FIGS. 2A, 2B and 3). In the high pressure single-fluid atomizers, a liquid or slurry fuel is pressurized to an elevated pressure which propels the fuel at high kinetic energy through an orifice into a nozzle injector. The atomized fuel leaving the nozzle injector is then sprayed into a combustor chamber. The high velocity of the fuel spray in turn provides for better mixing of the fuel and air and results in more efficient combustor performance.

A high pressure single-fluid atomizer as shown in FIG. 1 employs a high pressure pump to raise the pressure of the liquid fuel and to drive the atomizer. The pressurized fluid expands through the nozzle so as to impart a high velocity to the fluid, resulting in an atomized spray. The pump operation may be continuous or intermittent, with intermittent pumps being employed for fuel-injected internal combustion piston applications such as diesel and gasoline engines.

In dual-fluid atomizers, a separate atomization fluid is employed to achieve atomization of the liquid or slurry fuel. Generally, dual-fluid atomizers are either internally mixed as shown in FIGS. 2A and 2B or externally mixed as shown in FIG. 3. In internally mixed, dual-fluid atomizers, the atomizing fluid meets the fuel within an atomization chamber and the mixture is ejected at high velocity from a nozzle to form the atomized fuel spray. One such dual-fluid atomizer shown in FIG. 2A employs a Y-jet design where the atomization fluid (generally gas or steam) meets the liquid or slurry fuel at an acute angle. Another dual-fluid atomizer shown in FIG. 2B employs an eductor T-jet design where the atomization fluid flow meets the liquid or slurry fuel at a right angle. Such atomizers may operate as eductors and, in some applications, no pump is required for fuel introduction. In both of the internally mixed, dual-fluid atomizers described, mixing of the atomization fluid and the liquid or slurry fuel occur internally within the body of the atomizer before the atomized fuel spray leaves the atomizer.

In externally mixed, dual-fluid atomizers such as the one shown in FIG. 3, the atomizing fluid meets the liquid or slurry fuel outside the body of the atomizer. Mixing of the atomization fluid with the fuel outside the atomizer is particularly useful when coal slurries and viscous liquid fuels such as residual oils are employed. Such highly abrasive or highly viscous fuels tend to cause rapid erosion of the inner surfaces of the atomizer when an internally mixed atomizer is employed. By mixing the atomization fluid and fuels outside the body of the atomizer, rapid erosion is lessened.

In the particular externally mixed, dual-fluid atomizer shown in FIG. 3, an annular cavity distributes the liquid fuel or slurry around a supersonic jet of atomizing fluid. A film of liquid fuel is sheared by the supersonic flow of the atomizing fluid through the cavity to produce an atomized fuel spray. Fuel enters into the path of an atomization fluid after the atomization fluid exits from a supersonic nozzle. The atomization fluid is provided with sufficient velocity to sheer the fuel droplets into an acceptable atomized fuel spray.

As previously mentioned, high pressure, single-fluid atomizers are generally employed in diesel engines and similar fuel-injection applications, particularly when the flow rate profile versus time is to be controlled. Pressures employed in such single-fluid atomizers can be in excess of 10,000 pounds per square inch.

Where large power plants and boilers are involved, dual-fluid atomizers are generally preferred. Liquid fuel in such applications need not be pressurized to high levels, with pressures in the range of from about 50 to about 250 pounds per square inch being acceptable.

In each of the dual-fluid systems previously described, the atomization fluid typically employed is a compressible fluid such as air or steam. In compressed air systems, pressures in the range of from about 20 to about 180 pounds per square inch are generally used. Where steam is employed, the pressure range is generally from about 50 pounds per square inch to about 600 pounds per square inch depending on the application requirements.

With respect to the internally mixed atomizers, the ratio of atomization fluid to liquid fuel varies from about 0.07 to about 0.50 pounds of atomization fluid per pound of liquid fuel being atomized. For the externally mixed, dual-fluid atomizers, more atomization fluid flow is required. The amount of atomization fluid in such atomizers ranges from about 0.40 to about 3.0 pounds per pound of liquid fuel being atomized.

As may be expected with such prior art atomizers, a large amount of parasitic power is consumed by the air compressors to supply the atomization fluid. Although in internally mixed dual-fluid atomizers, as little as 1.5% of the entire plant output comprises the parasitic air power, externally mixed, dual-fluid atomizers typically require as much as 15% of total power plant output to operate the compressors. Moreover, as more viscous and more abrasive fuels are employed, the amount of air required for atomization increases substantially. In addition, large amounts of atomization air are required, particularly in the externally mixed atomization processes, resulting in the need for enormous compressors which require a significant portion of plant output for operating.

In summary, typical prior art atomizers require large amounts of compressed air or other fluid for atomization. Moreover, the internally mixed, dual-fluid atomizers often incur erosion problems. Accordingly, an efficient, non-eroding atomization process which does not require a substantial amount of parasitic power is needed.

The apparatus and processes according to the present invention overcome most, if not all, of the above-noted problems of the prior art and generally possess the desired attributes set forth above by using a pulse combustion apparatus to atomize fuels. The present atomization apparatus may be designed to supply atomized fuel to combustion, gasification, and other systems which employ atomized liquid or slurry streams.

SUMMARY OF THE INVENTION

It is thus an object of the present invention to provide improved atomization apparatus and processes for liquids and slurries.

Another object of the present invention is to provide an improved atomizer employing a pulse combustor for atomization of liquids and slurries.

Still another object according to the present invention is to provide a high efficiency fuel atomizer employing a pulse combustor to atomize the fuel.

It is yet another object of the present invention to provide a novel atomizer for liquids and slurries that does not have the parasitic power requirements of atomizers heretofore known.

Another object according to the present invention is to provide a fuel atomizer that does not suffer from rapid erosion when atomizing highly abrasive slurries or highly viscous liquids.

It is another object of the present invention to provide a combustor system employing a pulse combustion apparatus to atomize the fuel combusted in the combustion system.

It is yet another object of the present invention to provide a gasification system employing a pulse combustion based atomizer.

Generally speaking, apparatus according to the present invention includes an atomization apparatus comprising pulse combustion means for generating a stream of atomization fluid and a means for providing a fuel to the pulse combustion means so that atomized liquids or slurries are produced by the stream of atomization fluid acting thereon. The method for atomization according to the present invention generally comprises the steps of producing a stream of atomization fluid by pulse combustion and providing a liquid or slurry to be atomized to the stream of atomization fluid so that an atomized liquid or slurry is created that may be provided for further application.

Although the present invention is directed to atomization of liquids and/or slurries, the explanation of the claimed invention is generally exemplified by reference to the atomization of fuels. More specifically, one particular embodiment of the present invention includes an apparatus for creating and/or utilizing an atomized fuel comprising a pulse combustor for producing a stream of atomization fluid wherein the pulse combustor includes a combustion chamber, a valve in communication therewith for admitting fuel or air to the combustion chamber, a first fuel injector for admitting fuel to the pulse combustor and a resonance tube in communication with the combustion chamber. The apparatus further comprises a second fuel injector for admitting fuel to the pulse combustor so that the fuel admitted thereto may be atomized by the stream of atomization fluid. Furthermore, the resonance tube of the pulsed fuel atomizer is in communication with apparatus for utilizing the atomized fuel created therein such as combustion and gasification systems, and other similar types of devices wherein atomized fuel is preferred or acceptable.

A method for atomizing a fuel according to the present invention more specifically comprises the steps of supplying a pulse combustion fuel to a pulse combustor having a combustion chamber, a valve means for admitting fuel or air to the combustion chamber, and at least one resonance tube. The method further includes pulse combusting the pulse combustion fuel to produce a combustion stream of atomization fluid exiting from the combustion chamber and entering into the resonance tube. A liquid or slurry to be atomized is supplied to the pulse combustor after the stream of atomization fluid has been produced so that the liquid or slurry to be atomized is atomized by the stream of atomization fluid. Further, the method includes providing the atomized liquid or slurry, preferably a fuel, for further applications such as combustion and gasification.

As described herein, one particular and preferred apparatus of the present invention includes a pulse combustion means having a combustion chamber in communication with an aerodynamic valve for admitting fuel or air on demand to the pulse combustion chamber. The pulse combustion means includes one or more resonance tubes in communication with the combustion chamber. A means is provided for supplying fuel to the pulse combustion chamber so that a pulsating flow of atomization fluid is created. The apparatus further includes means downstream from the combustion chamber for supplying fuel to be atomized, and preferably takes the form of an injector. This second injector thus supplies the slurry or liquid fuel which is to be atomized to the atomization fluid so that atomization of the fuel occurs under the influence of the oscillating or pulsating flow field described herein. The pulse combustion means, when fired, produces a pulsating flow of combustion products which serves as an atomization fluid for the fuel supplied downstream. The fuel, which is preferably injected near the interface of the resonance tube and the combustion chamber, is then supplied to a main combustor cavity or other device such as a gasifier to utilize the atomized fuel in the combustion or gasification process.

Another particular embodiment of the present invention employs a supercharger for increasing the velocity of air admitted through the aerovalve described above. The supercharger may employ a forced draft fan, an air blower, an air compressor, or other device to pressurize the air provided to the combustion chamber through the aerovalve. When such high pressure air is supplied, the pulse combustion means operates under a supercharged air inlet condition.

BRIEF DESCRIPTION OF THE DRAWINGS

The construction designed to carry out the invention will be hereinafter described, together with other features thereof. The invention will be more readily understood from reading of the following specification and by reference to the accompanying drawings forming a part thereof, wherein an example of the invention is shown and wherein.

Figure 1:
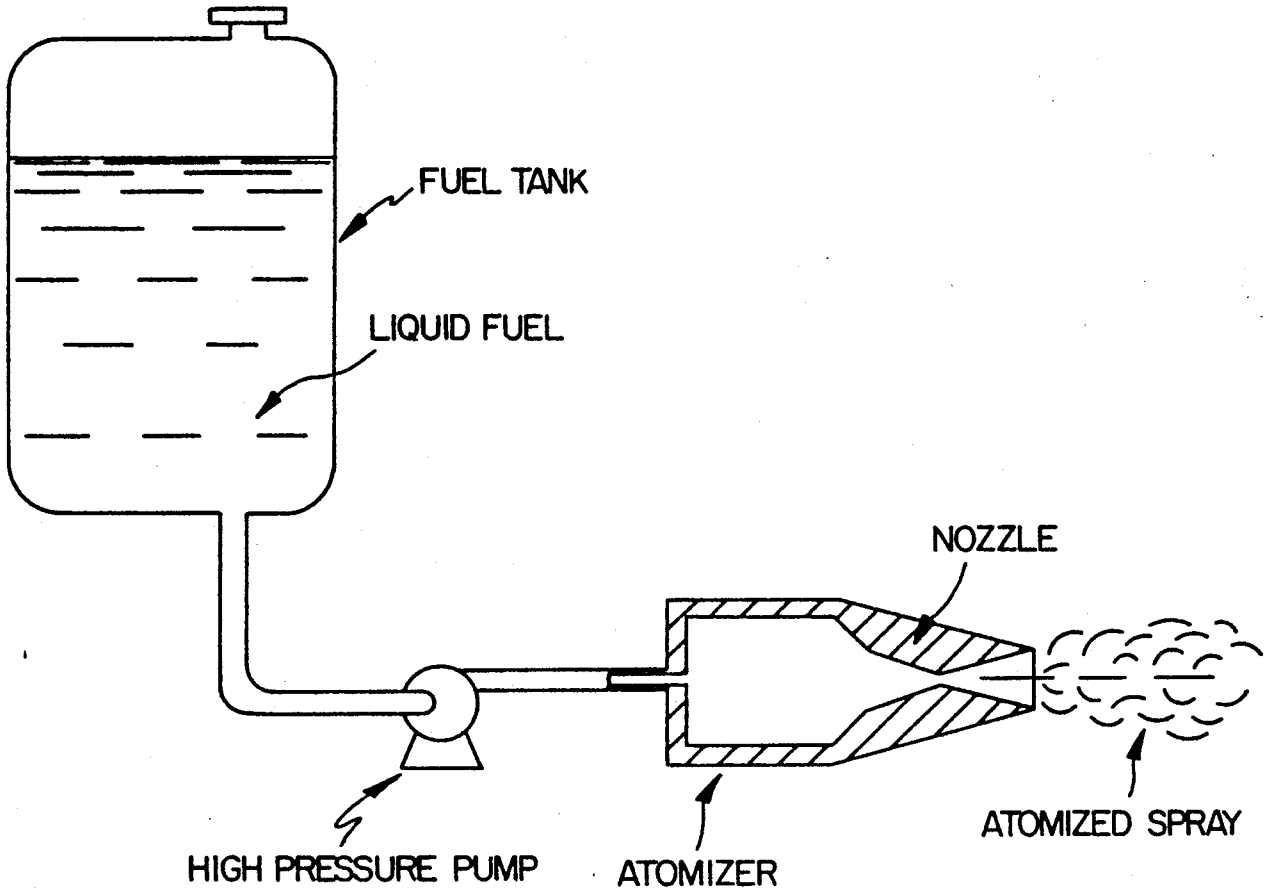
FIG. 1 PRIOR ART
FIG. 1 is a schematic illustration of a prior art high pressure, single-fluid atomizer.
Figure 2A:
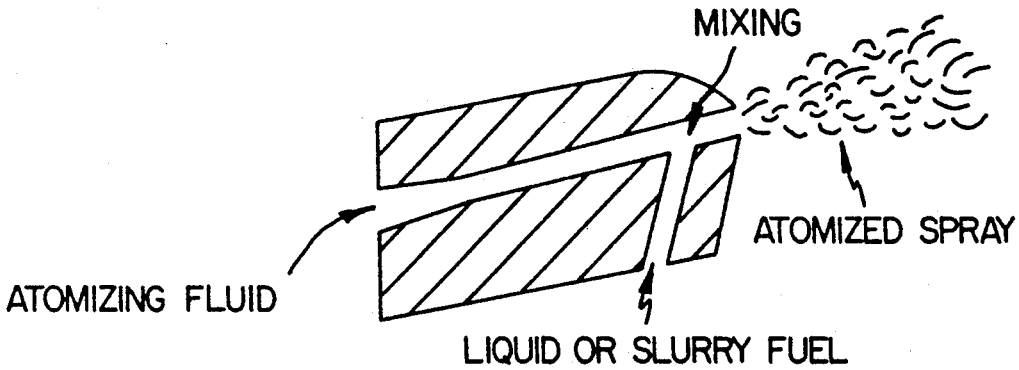
FIG. 2A PRIOR ART
FIG. 2A is a schematic illustration of a prior art Y-jet internally mixed, dual-fluid atomizer.
Figure 2B:
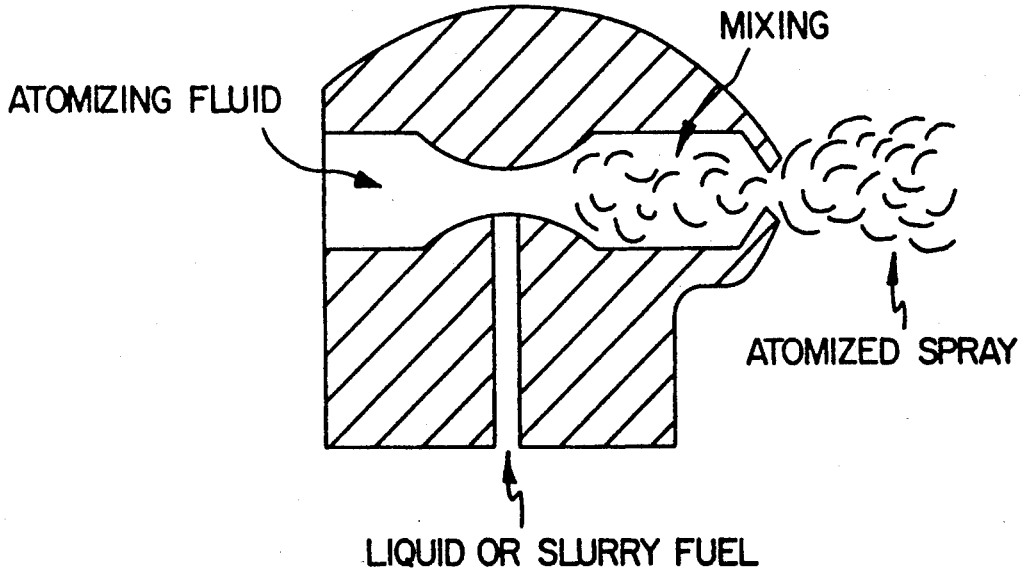
FIG. 2B PRIOR ART
FIG. 2B is a schematic illustration of a prior art eductor T-jet internally mixed, dual-fluid atomizer.
Figure 3:
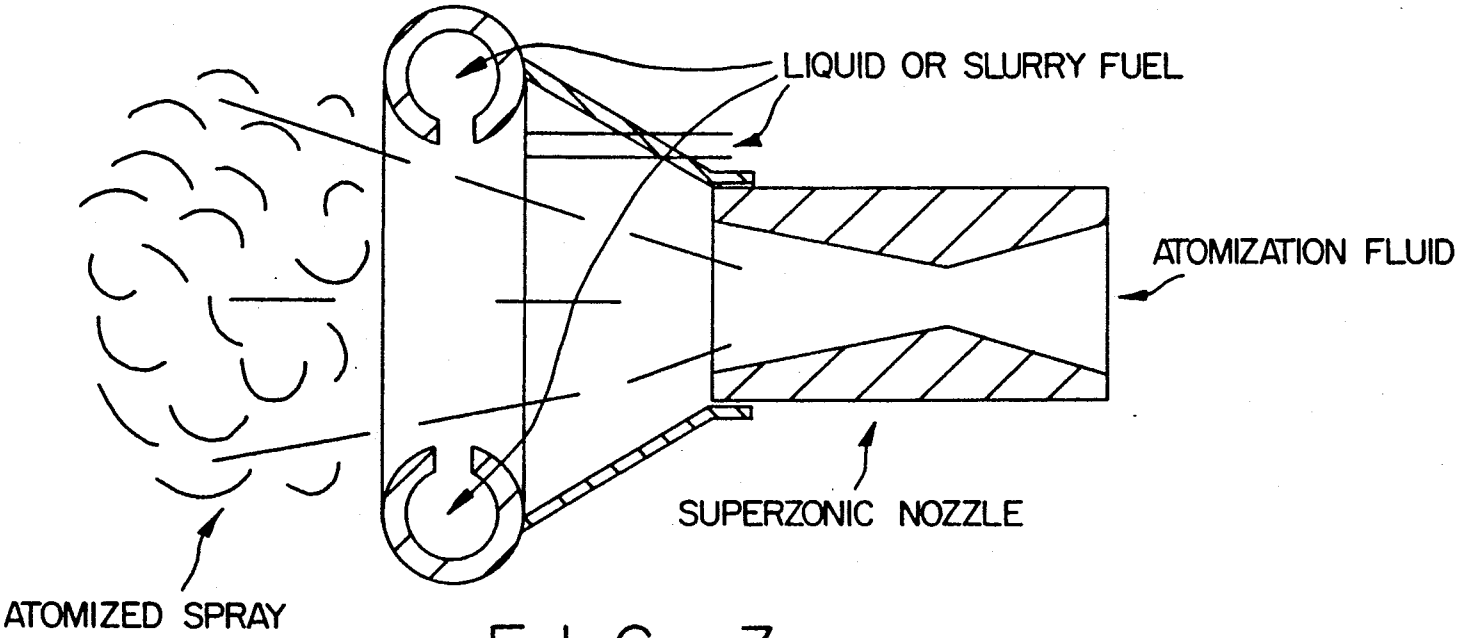
FIG. 3 PRIOR ART
FIG. 3 is a schematic illustration of a prior art externally mixed, dual-fluid atomizer.

Repeat use of reference characters in the present specification and drawings is intended to represent same or analogous features or elements of the invention in the various illustrations.

DESCRIPTION OF THE PREFERRED EMBODIMENTS

As previously mentioned, the invention is directed to the atomization of liquids and slurries. The description herein employs fuel as an example of a particular liquid or slurry that may be atomized accordingly.

The preferred apparatus for atomizing fuels according to the present invention employs a pulse combustor to produce an atomization fluid which is then utilized to atomize a further liquid or slurry. Heretofore, the use of a pulse combustor for the atomization of fuels has not previously been known. In essence, the present invention is a dual-fluid atomizer apparatus. A pulse combustor means creates an oscillating combustion product stream (or atomization fluid) which engages and atomizes a second fluid or slurry (preferably fuel) which is then provided in an atomized state for further use as desired, such as downstream combustion or gasification.

Figure 4:
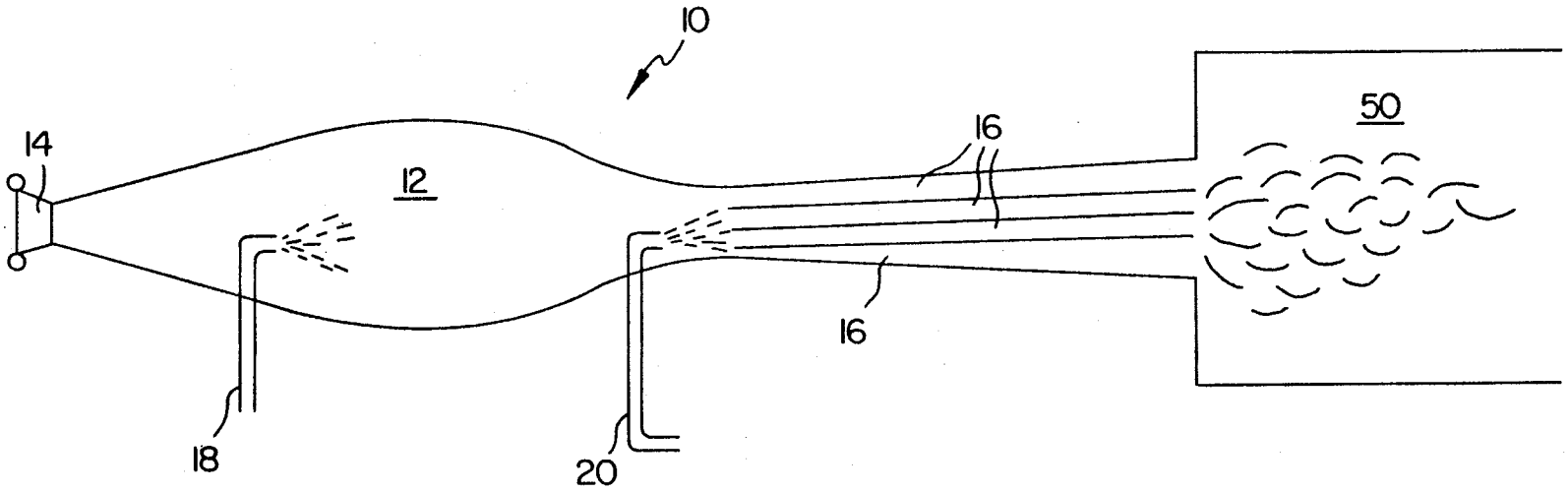
FIG. 4 is a schematic illustration of one particular embodiment of a pulse combustor-atomizer apparatus of the present invention.

FIG. 4 depicts one particular pulse combustor fuel atomization apparatus according to the present invention. Referring to FIG. 4, a pulse combustor is shown generally by the numeral 10. Pulse combustor 10 generally comprises a combustion chamber 12, a valve means 14 in communication with combustion chamber 12, and one or more resonance tubes 16 in communication with combustion chamber 12. One particular pulse combustion means that may be employed in the present invention is generally and specifically described in U.S. Pat. No. 5,059,404 to Mansour et al. which is incorporated herein by reference.

Specifically, pulse combustor 10 may employ an aerodynamic valve (fluidic diode), a mechanical valve or the like as valve means 14, a combustion chamber 12, and one or more tailpipes or resonance tubes 16. Additionally, pulse combustor 10 according to the present invention may include an air plenum and thrust augmenter or supercharger as described below with respect to FIG. 5.

The pulse combustor fuel atomizer of the present invention further includes a first fuel introduction means 18 for admitting of fuel for operation of the pulse combustor, though the combustor fuel could be admitted along with air through valve means 14. An additional fuel introduction means 20 is provided for introducing fuel which is to be atomized by the combustor apparatus 10. First fuel introduction means 18, preferably a fuel injector, provides fuel to combustion chamber 12 for firing the pulse combustor 10. Any conventional means may be employed to supply a fluid to the apparatus through first fuel and additional fuel introduction means 18 and 20. For example, conventional injection apparatuses which utilize pressurized fluid for spraying liquid fuel may be employed. Pressurized injectors, however, are not necessarily required because combustion chamber 12, acting as a vacuum source during operation as described herein, would draw fuel from first and additional fuel introduction means 18 and 20 without pressurization.

As also shown in FIG. 4, pulse combustor first fuel introduction means 18 preferably introduces fuel for firing the pulse combustion means 10 at an area near the junction of air valve means 14 and combustion chamber 12. Such positioning of first fuel introduction means 18, however, is not required in the present invention. In fact, and as mentioned above, first fuel introduction means 18 may be eliminated altogether. Instead, as described herein, valve means 14 may admit a fuel/air mixture to combustion chamber 12 so that an additional fuel path exemplified by first fuel introduction means 18 is not required.

As seen in FIG. 4, combustion chamber 12 is in communication with resonance tube 16 for receipt of an oscillating stream of combustion products. Additional fuel introduction means 20, which adds fuel to be atomized, is preferably located near the juncture of the resonance tube(s) 16 and combustion chamber 12. However, as will be appreciated, additional fuel introduction means 20 may be located anywhere along resonance tube(s) 16 provided the stream of atomization fluid created by pulse combustion in combustion chamber 12 can act thereon under influence of the oscillating flow field to atomize the fuel.

Combustion chamber 12 and resonance tube(s) 16 form a tuned Helmholtz resonator as described herein. Valve means 14 acts as a diode such that self-air aspiration is affected in response to an oscillating pressure in combustion chamber 12 induced as a result of heat and mass release from combustion therein. As described below, variations of the present invention include the use of a mechanical valve instead of an aerodynamic valve for valve means 14.

A pulse combustor, such as that employed in the present invention, typically operates in the following manner. Fuel enters combustion chamber 12 through first fuel introduction means 18 or, alternatively, through valve means 14. Air enters combustion chamber 12 through valve means 14. An emission or spark source (not shown) detonates the explosive mixture during start-up. A sudden increase in volume, triggered by the rapid increase in temperature and evolution of combustion products, pressurizes combustion chamber 12. As the hot gas expands, valve means 14 in the form of a fluidic diode, permits preferential flow in the direction of resonance tube(s) or tailpipe(s) 16. The gaseous combustion product stream, which is the atomization fluid in the present invention exiting combustion chamber 12, possesses significant momentum. A vacuum is created in combustion chamber 12 due to the inertia of the atomization fluid within resonance tube(s) 16 and permits only a small fraction of atomization fluid to return to combustion chamber 12, with the balance of the atomization fluid, or gas, exiting through resonance tube(s) 16. Because the chamber pressure is then below atmospheric pressure, air and fuel mixtures are drawn into chamber 12 where auto-ignition takes place. Again, valve means 14 constrains reverse flow, and the cycle begins anew. Once the first cycle is initiated, engine operation is thereafter self-sustaining or self-aspirating.

The valve means utilized in many pulse combustion systems is a mechanical "flapper valve". The flapper valve is actually a check valve permitting flow from inlet to the combustion chamber, and constraining reverse flow by a mechanical seating arrangement.

Although such mechanical valves may be used in conjunction with the present system, an aerodynamic valve without moving parts is preferred. With an aerodynamic valve, a boundary layer builds in the valve during the exhaust stroke and turbulent eddies choke off much of the reverse flow. Moreover, the exhaust gases have a much higher temperature than the inlet gases.

Accordingly, the viscosity of the gas is much higher and the reverse resistance of the inlet diameter, in turn, is much higher than that for forward flow through the same opening. These phenomena, along with the high inertia of the atomization fluid exhausting in resonance tube(s) 16, combine to yield preferential and mean flow from inlet to exhaust. Thus, pulse combustion creates a self-aspirating engine, drawing its own air and fuel into combustion chamber 14, auto-igniting, and creating combustion products to form the atomization fluid utilized in the present invention.

A preferred pulse combustor used herein, and as noted above, is based on a Helmholtz configuration with an aerodynamic valve. The pressure fluctuations, which are combustion-induced in the Helmholtz resonator-shaped combustor, coupled with the fluidic diodicity of the aerodynamic valve, cause a bias flow of air and fluid from the combustor's inlet to the exit of resonance tube(s) 16. This results in the combustion air being self-aspirated by the combustor and for an average pressure boost to develop in the combustion chamber to expel the products of combustion at a high average flow velocity (typically over 1,000 ft./sec.) into and through resonance tube(s) 16.

The production of an intense acoustic wave is an inherent characteristic of pulse combustion. Sound intensity adjacent to the wall of combustion chamber 12 is normally in the range of 110–190 dB. The range may be altered depending on the desired acoustic field frequency to accommodate the specific application undertaken by the pulse combustor.

A rapid pressure oscillation through combustion chamber 12 generates an intense oscillating flow field. The fluctuating flow field causes the atomization fluid, or products of combustion, to be swept away from the fuel which is firing the pulse combustor, thus providing access to oxygen with little or no diffusion limitation. Secondly, pulse combustors experience very high mass and heat transfer rates within the combustion zone. While these combustors tend to have very high heat release rates (typically 10 times those of conventional burners), the vigorous mass transfer and high heat transfer within the combustion region result in a more uniform temperature. Thus, peak temperatures attained are much lower than in the case of conventional systems, resulting in a significant reduction in nitrogen oxides ($NO_x$) formation as described in U.S. Pat. No. 5,059,404. The high heat release rates also result in a smaller combustor size required for a given firing rate and a reduction in the required resonance time.

Pulse combustor systems of the present invention regulate their own stoichiometry within their range of firing without need of extensive controls to regulate the fuel feed to combustion air mass flow rate ratio. As the fuel feed rate is increased, the strength of the pressure pulsations in combustion chamber 12 increases which, in turn, increases the amount of air aspirated by the aerodynamic valve. Thus, the combustor automatically maintains a substantially constant stoichiometry over its designed firing range. The induced stoichiometry can be changed by modifying the aerodynamic valve fluidic diodicity.

In certain embodiments of the present invention, two (2) pulse combustors may be arranged in a tandem configuration wherein two pulse combustors as shown in FIG. 4 are operated in close proximity. The tandem operation employs a 180° phase lag between each combustor unit and results in super-positioning of acoustic waves and cancellation of the fugitive sound emissions.

Such tandem combustors may be configured so that a fuel "T" acts as a coupling allowing automatic fuel biasing between each of the in-tandem pulse combustion units. Under these conditions, one combustion chamber achieves a low pressure phase just as the other chamber simultaneously achieves a high pressure phase. Due to the pressure gradient existing in the fuel coupling, combustion products are accelerated from the high pressure chamber to the low pressure chamber. The momentum of the accelerated gases biases a flow of fuel from the main fuel source into the fuel line "T" and eventually into the low pressure combustion chamber. A half-cycle later, a similar phenomenon occurs in the opposing direction. By these means, fuel can be properly phased without the use of mechanical flapper valves or an independent phasing chamber. The natural instability of the tandem units employing a common fuel coupling line is sufficient to automatically pull the two combustion units 180° out of phase because the units inherently hunt for the most stable and robust operating state. That state results in efficient fuel phasing, i.e., a 180° phase lag.

Various other modifications can be made to pulse combustor 10 of the present invention. For example, if desired, water-cooled jackets may be utilized for withdrawing heat from resonance tube(s) 16 for directing to a boiler or other heated fluid device. Furthermore, resonance tube(s) 16 may employ a number of different designs. For example, the tube may flare continuously outwardly allowing the entire resonance tube to act as a diffuser to reduce gas exit velocity from combustion chamber 12 prior to entry into a main combustor cavity or gasification system. Moreover, resonance tube(s) 16 may be essentially straight, but have at its outer end a diffuser section that consists of an outwardly flaring tailpipe section, or alternatively, may integrate a diffuser section at the end nearest combustion chamber 12 with an essentially straight tube extending therefrom.

When operated according to the present invention, pulse combustor means 10 produces a pulsating flow of atomization fluid and an acoustic wave having a frequency in a range of from about 20 to about 1500 Hz. As fuel is combusted, a pulsating flow of atomization fluid exits combustion chamber 12 and passes into resonance tube(s) 16. The stream of atomization fluid leaving combustion chamber 12 is at a sufficient velocity so as to atomize the fuel being injected or provided by additional fuel introduction means 20. After the atomization fluid meets the fuel to be atomized, fuel is atomized and travels along resonance tube(s) 16 gaining further speed until the atomized fuel is provided to a main combustor cavity or other application.

A suitable pulse jet fuel is provided to combustion chamber 12 through first introduction means 18 and/or valve means 14. Typically, a highly flammable fuel such as natural gas, propane, hydrogen-rich synthesis gas, and other such gases are preferred to fire pulse combustion means 10. It is possible, however, to use liquid fuels, preferably light distillates such as gasoline and kerosene. Furthermore, solid fuel such as lignite coals, sawdust, and other highly reactive solids may be used for firing the pulse combustion means 10. The higher the flammability of the fuel employed, the higher the attainable dynamic pressure amplitude induced by the spontaneous resonance of the Helmholtz resonator. Furthermore, highly flammable fuels provide higher heat release rates per unit volume of the Helmholtz resonator.

As previously described, the oscillating dynamic pressures in combustion chamber 12, in the presence of an aerovalve or properly designed mechanical valve, give rise to a pressure boost in combustion chamber 12 that propels the atomization fluid through resonance tube(s) 16 at high velocity. The high kinetic energy in the flow of atomization fluid through the resonance tube is employed to atomize fuel provided by fuel injector means 20. From resonance tube(s) 16, the atomized fuel is introduced into a main combustor cavity 50 where additional combustion air is added and the atomized fuel is combusted.

By varying the amount of excess air provided to pulse combustion means 10 and the amount of fuel being atomized for consumption by the main combustor, the temperature of the atomized spray can be modified. Furthermore, in the case of a slurry fuel, adjustments to the pulse combustion stoichiometry and the ratio between the firing rate of the pulse combustion to the main combustor firing rate results in dry coal or other solid fuel emanating from the pulse jet atomizer into the main combustor cavity. Furthermore, firing the pulse combustion means at near stoichiometric air conditions (e.g., 3% excess air in the flue) and at a sufficiently high firing rate, allows the atomized fuel emanating from the atomizer to produce pre-ignited volatiles and ignited fines together with the volatilized larger solid fuel particles from the fuel slurry. This, in turn, anchors the flame within the main combustor cavity and allows higher turndown of the main combustor without flame-out. Furthermore, when operating under such atomization/drying, devolatilizing and pre-ignition parameters, preheating or the main combustor's combustion air to stabilize the combustion of the atomized slurry can be eliminated.

The pulse combustor atomizer apparatus of the present invention is operated in the following manner. A fuel for combusting in the pulse combustor is provided to pulse combustion chamber 12 through first fuel introduction means 18 or, alternatively, is provided through valve means 14 as an air/fuel mixture. Air is provided through valve means 14 and an ignition source (not shown) ignites the fuel for combustion in combustion chamber 12. Combustion of the fuel creates a pulsating flow of combustion products used as the atomization fluid of the present invention. The pulsating combustion is self-aspirating as described herein. The flow of atomization fluid leaving combustion chamber 12 travels to and through one or more resonance tubes 16. At a location at or near the juncture of resonance tube(s) 16 and combustion chamber 12, an additional fuel introduction means 20 provides the fuel to be atomized by the pulse combustor 10. Fuel to be atomized and which is supplied through additional fuel introduction means 20 is provided to the flow of atomization fluid so that the oscillating, or pulsating, flow field previously described can act thereon so as to cause atomization of the fuel. The fuel which is then atomized is provided downstream for further processing such as combustion, gasification, etc.

With such a pulse combustion atomization apparatus, drying, devolatilization, and pre-ignition of the fuel injected into the pulse combustion means are achieved at a very high rate in the hot oscillating flow field found in resonance tube(s) 16. This allows deep staging of the main combustor to reduce $NO_x$ production as previously described. Furthermore, high turndown without flame-out and moderate combustion temperature which further reduces thermal $NO_x$ formation and a high combustion efficiency with little to no air preheating is thereby achieved. This, of course, eliminates the need for costly combustion air preheaters as required by the prior art and saves on capital and maintenance costs while providing superior main combustor performance with slurry and liquid fuels.

Therefore, when the described pulse combustion fuel atomizer is employed to atomize slurry and liquid fuels, several desirable benefits are achieved. For example, the need for compressed air for atomization of the fuels is eliminated. This, of course, eliminates both the parasitic power required for generation of the compressed air and the capital and maintenance costs required to provide the compressor equipment. Furthermore, the erosion problems incurred with the previously-described internally mixed, dual-fluid atomization devices are avoided. In addition, the high parasitic power requirements of the externally mixed, dual-fluid atomizers are reduced. The pulse combustion atomizer of the present invention essentially operates as an externally mixed, dual-fluid atomizer having lower erosion rates. The atomization fluid is generated in a self-aspirating pulse combustion means by burning fuel. Such generation occurs in a system which requires no essential moving parts and no air compressors.

Finally, superior fuel preparation for efficient combustion and for gasification with flame stability, high turndown, and decombustion staging potential is recognized over the current internally mixed and externally mixed, dual-fluid atomizers. In conventional dual-fluid atomizers, the droplet size of an atomized slurry is generally larger than the size of some of the coal particles present in the initial slurry, resulting in a water-laden fuel. Water-laden coals require a number of additional combustion processes to vaporize the water from the droplets as well as for devolatilization and ignition of the fuel. In addition, when certain cracking coals (such as bituminous coals typically used to manufacture slurry fuels) are used, agglomerates of fine particles are formed from multi-particle droplets resulting in a reduced surface-to-mass ratio of the burning fuel. Furthermore, the presence of water in the slurry generally requires significant preheated combustion air in order to avoid flame-out in the main combustor. Even with combustion air preheating, the combustor turndown and extent of staging, particularly deep staging, are limited with slurry fuels because of the present of water in the fuels. Such is not the case with slurry fuels atomized by the present invention which undergo significant drying, devolatilization, and pre-ignition.

Additionally, the pulse combustion atomizer results in increased mixing of fuel with air due to the pulsation of the combustion products stream. Moreover, the presence of solids in the atomization fluid stream give rise to an increase in the atomization ability of the stream.

Figure 5:
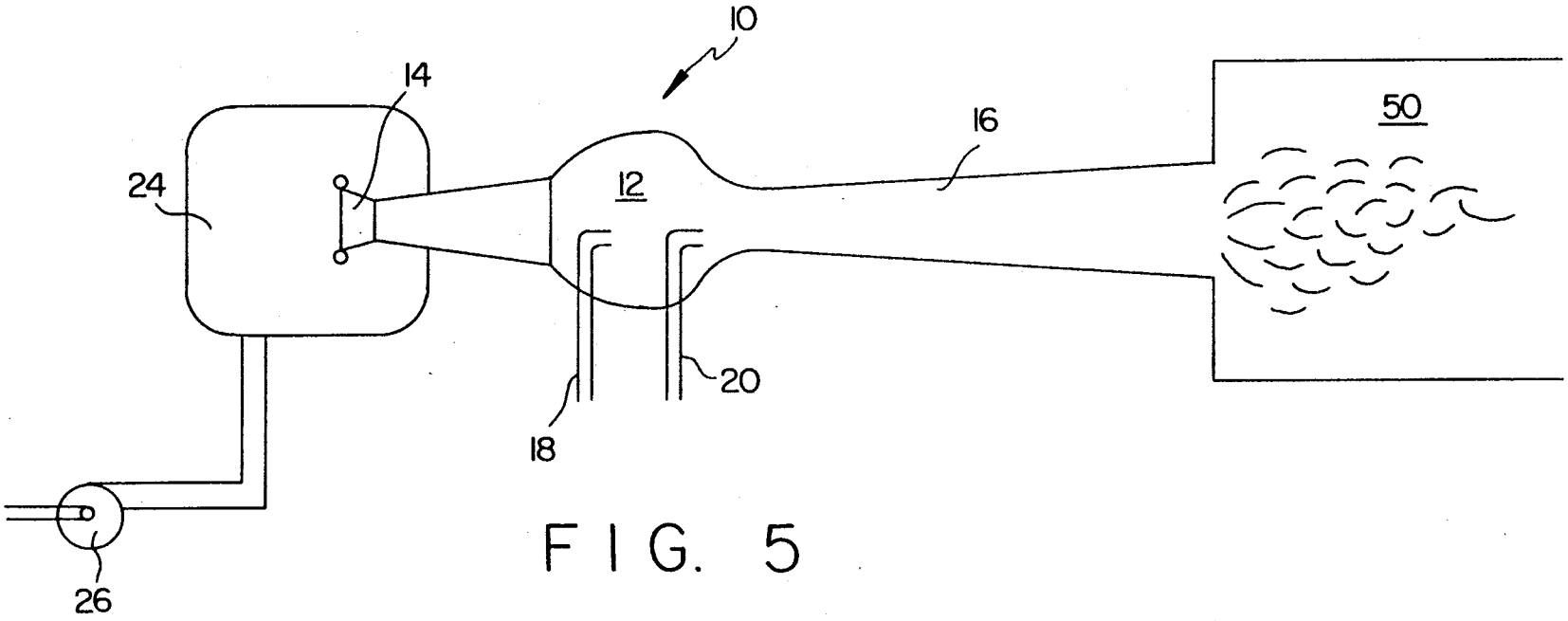
FIG. 5 is another particular embodiment of a pulse combustor-atomizer of the present invention wherein an air supercharger has been added thereto.

In another embodiment of the present invention, a pulse combustion atomizer may be operated under a pressurized or supercharged inlet air condition. As depicted in FIG. 5, an air plenum 24 may be connected through conduits to a supercharger 26. Supercharger 26 may be a forced draft fan employed for supplying primary air to air plenum 24. Air plenum 24 operates as a capacitor and seeks to provide primary air to pulse combustion means 10 at approximately constant static pressure. The pressure boost developed due to pulse combustion within the present embodiment allows a reduction in the size, power requirements, and cost of forced draft supercharger 26. Supercharger 26 may, instead, consist of an air blower, an air compressor, or other device for supercharging the air fed to valve means 14.

As shown in FIGS. 4 and 5, fuel that has been atomized by pulse combustion means 10 may be supplied to a main combustor cavity 50. In addition, atomized fuel produced by the present apparatus may be supplied to a gasification device as generally known in the art and described in U.S. Pat. No. 5,059,404. The main combustor cavity may consist of a further pulse combustion means or may, instead, be a typical conventional combustion unit.

Although preferred embodiments of the invention have been described using specific terms, devices, concentrations, and methods, such description is for illustrative purposes only. The words used are words of description rather than of limitation. It is to be understood that changes and variations may be made without departing from the spirit or the scope of the following claims.

What is claimed is:

1. A liquid or slurry atomization apparatus comprising:

a) a pulse combustor for generating an oscillating flow field of atomization fluid, said pulse combustor including means for introduction of fuel thereto, valve means for introduction of air thereto, a combustion chamber in communication with said valve means, and a resonance tube in communication with said combustion chamber wherein said resonance tube and said combustion chamber communicate with each other at a juncture; and b) means for introducing a liquid or slurry to be atomized to said pulse combustor, said introduction means being located adjacent said juncture of said combustion chamber and said resonance tube so that said liquid or slurry may be atomized.

2. Apparatus as defined in claim 1 wherein said means for introducing said liquid or slurry to be atomized is located at said resonance tube.

3. Apparatus as defined in claim 1 wherein said valve means for providing air and said means for introducing fuel to said combustion chamber is the same, and is an aerodynamic valve.

4. Apparatus as defined in claim 1 wherein said atomization apparatus is in upstream communication with a further combustion means for receiving said atomized liquid or slurry.

5. Apparatus as defined in claim 4 wherein said further combustion means comprises a pulse combustor.

6. Apparatus as defined in claim 1 further comprising gasifying means in communication with said pulse combustor for receiving said atomized liquid or slurry.

7. A fuel atomizer apparatus comprising:

a) a pulse combustor capable of producing a pulsating flow of atomization fluid and an acoustic wave at a frequency in a range of from about 20 to about 1500 Hz, said pulse combustor comprising a combustion chamber, means for introducing fuel and air to said combustion chamber, and at least one resonance tube in communication with said combustion chamber; and b) means for introducing a fuel to be atomized to said pulse combustor adjacent the location where said resonance tube and said combustion chamber communicate so that said fuel to be atomized may come under the influence of said pulsating flow of atomization fluid to produce atomized fuel.

8. Apparatus as defined in claim 7 wherein said resonance tube is in further communication with a means for combusting said fuel that has been atomized.

9. Apparatus as defined in claim 7 wherein said resonance tube is in further communication with a gasifying means.

10. Apparatus as defined in claim 7 wherein said pulse combustor includes separator means for supplying air and fuel for firing said pulse combustor.

11. Apparatus as defined in claim 7 wherein said means for supplying air is a valve means and wherein said pulse combustor further comprises means for supplying pressurized air to said valve means so that said pulse combustor is capable of operating under a supercharged inlet air condition.

12. An apparatus for creating and utilizing an atomized fuel comprising:

a) a pulse combustor for producing an oscillating stream of atomization fluid, said pulse combustor having a combustion chamber, valve means in communication with said combustion chamber for admitting air to said combustion chamber, a first fuel introduction means for admitting fuel to said pulse combustor for the firing of same, and a resonance tube in communication with said combustion chamber;

b) means for admitting an additional fuel to said pulse combustor at a location near the point where said resonance tube and said combustion chamber communicate so that said fuel may be atomized by said stream of atomization fluid under the influence of said oscillating flow field; and c) means in communication with said resonance tube for utilizing said atomized fuel produced by said pulse combustor.

13. A method for atomizing liquids or slurries comprising:

a) pulse combusting a fuel in a combustion chamber;

b) generating combustion-induced oscillations to produce a stream of atomization fluid; and c) introducing a liquid or slurry to be atomized to the influence of said stream of atomization fluid immediately after combusting said fuel so that an atomized liquid or slurry is produced under the influence of said oscillated stream.

14. A method as defined in claim 13, wherein said liquid or slurry to be atomized is fuel and said method produces atomized fuel.

15. A method as defined in claim 14 further comprising the step of providing said atomized fuel to a means for combusting same.

16. A method as defined in claim 14 further comprising the step of providing said atomized fuel to a gasifying means.

17. A method for atomizing a fuel with a pulse combustor having a combustion chamber, means to introduce air and fuel into said combustion chamber, and at least one resonance tube in abutting relationship with said combustion chamber comprising the steps of: abutting relationship with said combustion chamber comprising the steps of:

a) supplying a fuel to said combustion chamber;

b) supplying air on demand to said combustion chamber;

c) pulse combusting said air and fuel mixture supplied to said combustion chamber to produce an oscillating flow field of atomization fluid exiting from said combustion chamber and entering into said resonance tube;

d) introducing a fuel to be atomized to said field of atomization fluid adjacent a location where said combustion chamber and said resonance tube abut so that said fuel is atomized by said atomization fluid under the influence of said oscillating flow field to produce an atomized fuel; and e) providing said atomized fuel for further application.

* * * * *